US010273843B2

(12) United States Patent
Ishihara et al.

(10) Patent No.: US 10,273,843 B2
(45) Date of Patent: Apr. 30, 2019

(54) LUBRICATING STRUCTURE FOR FOUR-STROKE ENGINE

(71) Applicant: SUZUKI MOTOR CORPORATION, Shizuoka-Ken (JP)

(72) Inventors: Yasuomi Ishihara, Hamamatsu (JP); Takashi Tsutsumi, Hamamatsu (JP)

(73) Assignee: SUZUKI MOTOR CORPORATION (JP)

( * ) Notice: Subject to any disclaimer, the term of this patent is extended or adjusted under 35 U.S.C. 154(b) by 91 days.

(21) Appl. No.: 15/399,409

(22) Filed: Jan. 5, 2017

(65) Prior Publication Data

US 2017/0191388 A1 Jul. 6, 2017

(30) Foreign Application Priority Data

Jan. 6, 2016 (JP) ..... 2016-001180

(51) Int. Cl.

| | |
|---|---|
| ***F01M 11/02*** | (2006.01) |
| ***F01M 13/00*** | (2006.01) |
| ***F02B 75/02*** | (2006.01) |
| ***F01M 11/00*** | (2006.01) |
| ***F02B 61/04*** | (2006.01) |

(52) U.S. Cl.

CPC ..... *F01M 11/02* (2013.01); *F01M 11/0004* (2013.01); *F01M 13/0011* (2013.01); *F02B 61/045* (2013.01); *F02B 75/02* (2013.01); *F01M 2013/0044* (2013.01); *F02B 2075/027* (2013.01)

(58) Field of Classification Search

CPC .. F01M 11/02; F01M 11/004; F01M 13/0011; F01M 2013/044; F01M 2013/0038; F02B 61/045

See application file for complete search history.

(56) References Cited

U.S. PATENT DOCUMENTS 7,481,197 B1 * 1/2009 Li ..... F01M 9/06 123/196 CP

FOREIGN PATENT DOCUMENTS

JP S61-98909 A 5/1986

* cited by examiner

*Primary Examiner* — Jacob Amick

(74) *Attorney, Agent, or Firm* — Barnes & Thornburg LLP

(57) ABSTRACT

A lubricating structure for a four-stroke engine includes a first oil groove and a second oil groove. The engine includes a crankcase, a cylinder, a cylinder head and an oil pan. The crankcase makes up a crank chamber. The cylinder head is equipped with a valve chamber housing valve driving mechanism. The oil pan is provided on a bottom of the crank chamber. The first oil groove leads mist of the lubricating oil in the crank chamber to the valve chamber by communicating the crank chamber and the valve chamber with each other. The second oil groove leads surplus lubricating oil in the valve chamber to the oil pan in the crank chamber by communicating a lower part of the valve chamber with a neighborhood of the oil pan in the crank chamber. The first oil groove is set smaller in flow path cross-sectional area than the second oil groove.

8 Claims, 11 Drawing Sheets

LUBRICATING STRUCTURE FOR FOUR-STROKE ENGINE

CROSS-REFERENCE TO RELATED APPLICATIONS

This application claims the benefit of priority of Japanese Patent Application No. 2016-001180, filed Jan. 6, 2016, the entire contents of which are incorporated herein by reference.

BACKGROUND OF THE INVENTION

Field of the Invention

The present invention relates to a lubricating structure for a four-stroke engine, where the lubricating structure lubricates a valve driving mechanism in a cylinder head installed consecutively with a cylinder installed in a crankcase, extending horizontally.

Description of the Related Art

Patent Document 1 (Japanese Patent Laid-Open No. S61-98909) discloses a lubricating structure for a four-stroke engine, in which a cylinder is installed extending horizontally in a crankcase making up a crank chamber, a cylinder head equipped with a valve chamber configured to house a valve driving mechanism is installed consecutively with the cylinder and an oil pan configured to accumulate lubricating oil is provided on a bottom of the crank chamber, wherein the crank chamber and the valve chamber are communicated with each other via a first oil groove and a second oil groove, a check valve configured to permit only flow from the crank chamber to the valve chamber is disposed in the first oil groove, and surplus lubricating oil in the valve chamber is returned (discharged) to the crank chamber by increasing internal pressure in the valve chamber using the check valve.

However, in order to return lubricating oil in the valve chamber to the crank chamber, the lubricating structure for an engine described in Patent Document 1 needs a check valve, which is a dedicated part. Existence of the check valve makes it hard for a mist of the lubricating oil in the crank chamber to flow into the valve chamber, making it necessary to install a dedicated lubricating oil supply line running from the crank chamber to the valve chamber and thereby forcibly lubricate the valve driving mechanism in the valve chamber.

SUMMARY OF THE INVENTION

The present invention has been made in consideration of the above circumstances, and an object of the present invention is to provide a lubricating structure for a four-stroke engine that allow surplus lubricating oil to be returned properly to the crank chamber from within the valve chamber of the cylinder head connected to the horizontally extending cylinder without using a dedicated part.

The above and other objects can be achieved according to the present invention by providing, in one aspect, a lubricating structure for a four-stroke engine includes a first oil groove and a second oil groove. The four-stroke engine includes a crankcase, a cylinder, a cylinder head and an oil pan. The crankcase makes up a crank chamber. The cylinder with a piston slidably disposed therein is installed extending horizontally in the crankcase. The cylinder head is installed consecutively with the cylinder and is equipped with a valve chamber configured to house valve driving mechanism. The oil pan configured to accumulate lubricating oil is provided on a bottom of the crank chamber. The first oil groove leads mist of the lubricating oil in the crank chamber to the valve chamber by communicating the crank chamber and the valve chamber with each other. The second oil groove leads surplus lubricating oil in the valve chamber to the oil pan in the crank chamber by communicating a lower part of the valve chamber with a neighborhood of the oil pan in the crank chamber. The first oil groove is set smaller in flow path cross-sectional area than the second oil groove.

Reciprocating motion of a piston causes pressure in the crank chamber to pulsate by alternating positive pressure and negative pressure, and accordingly, pressure in the valve chamber also pulsates by alternating positive pressure and negative pressure. In so doing, due to a difference in cross-sectional areas of flow paths such as the first oil groove and second oil groove which communicate the crank chamber and valve chamber with each other, the pressure in the valve chamber causes a pulsation difference such as a pulsation delay (phase difference) or amplitude reduction (amplitude difference) with respect to the pressure in the crank chamber and results in a state of being higher than the pressure in the crank chamber.

Now, when the first oil groove is set smaller in flow path cross-sectional area than the second oil groove, it becomes easy for a fluid to flow through the second oil groove, and thus surplus lubricating oil accumulated in a lower part of the valve chamber can be returned to the crank chamber through the second oil groove. Consequently, surplus lubricating oil can be returned properly to the crank chamber from within the valve chamber of the cylinder head without using a dedicated part.

The nature and further characteristic features of the present invention will be described hereinafter in the following descriptions made with reference to the accompanying drawings, and the other advantages effects and functions of the present invention will be also made clear hereinafter.

DETAILED DESCRIPTION

An embodiment of the present invention will be described below with reference to the drawings.

Figure 1:
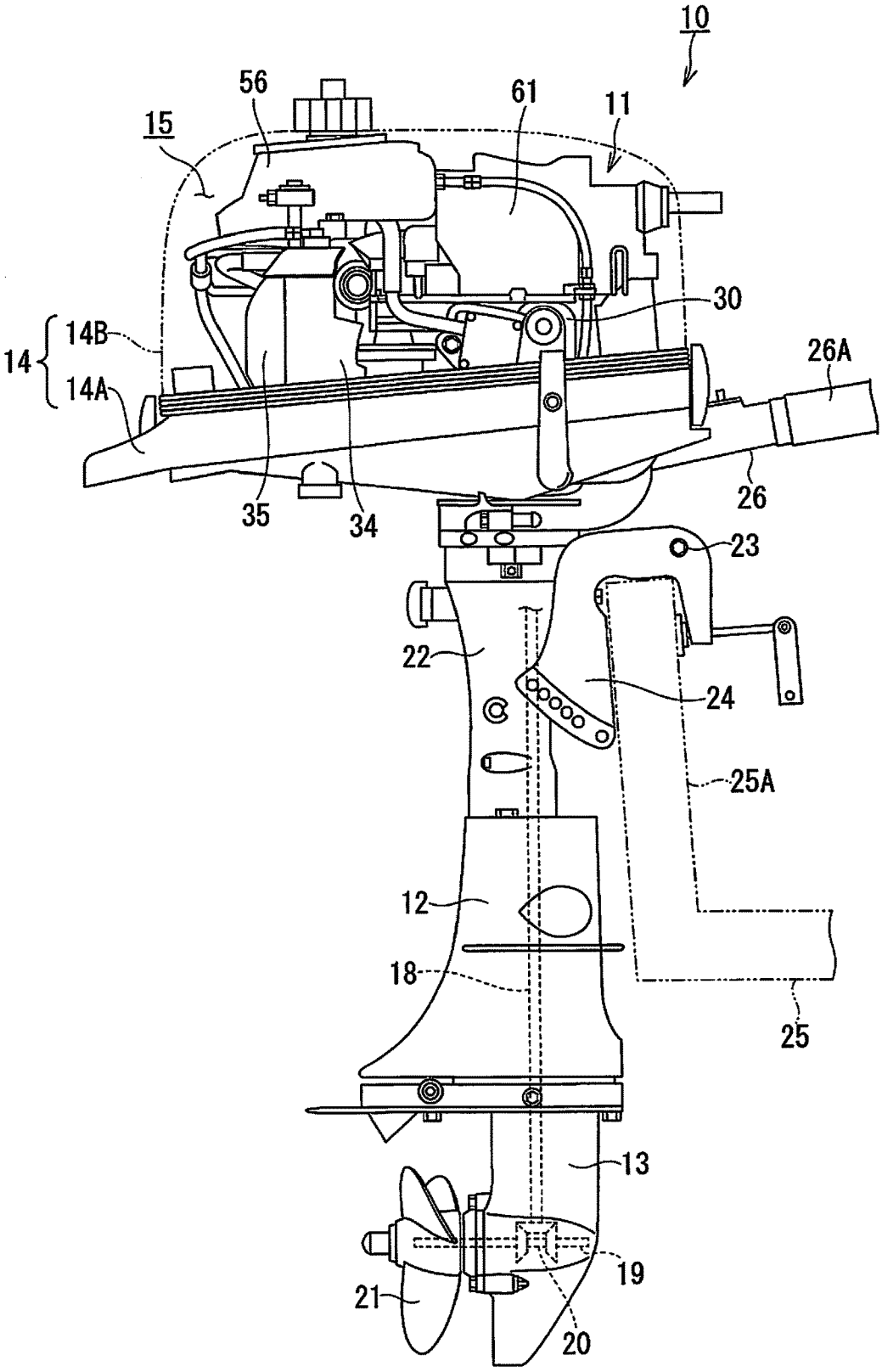
FIG. 1 is a right side view showing an outboard motor equipped with an engine resulting from application of a lubricating structure for a four-stroke engine according to an embodiment of the present invention.
Figure 2:
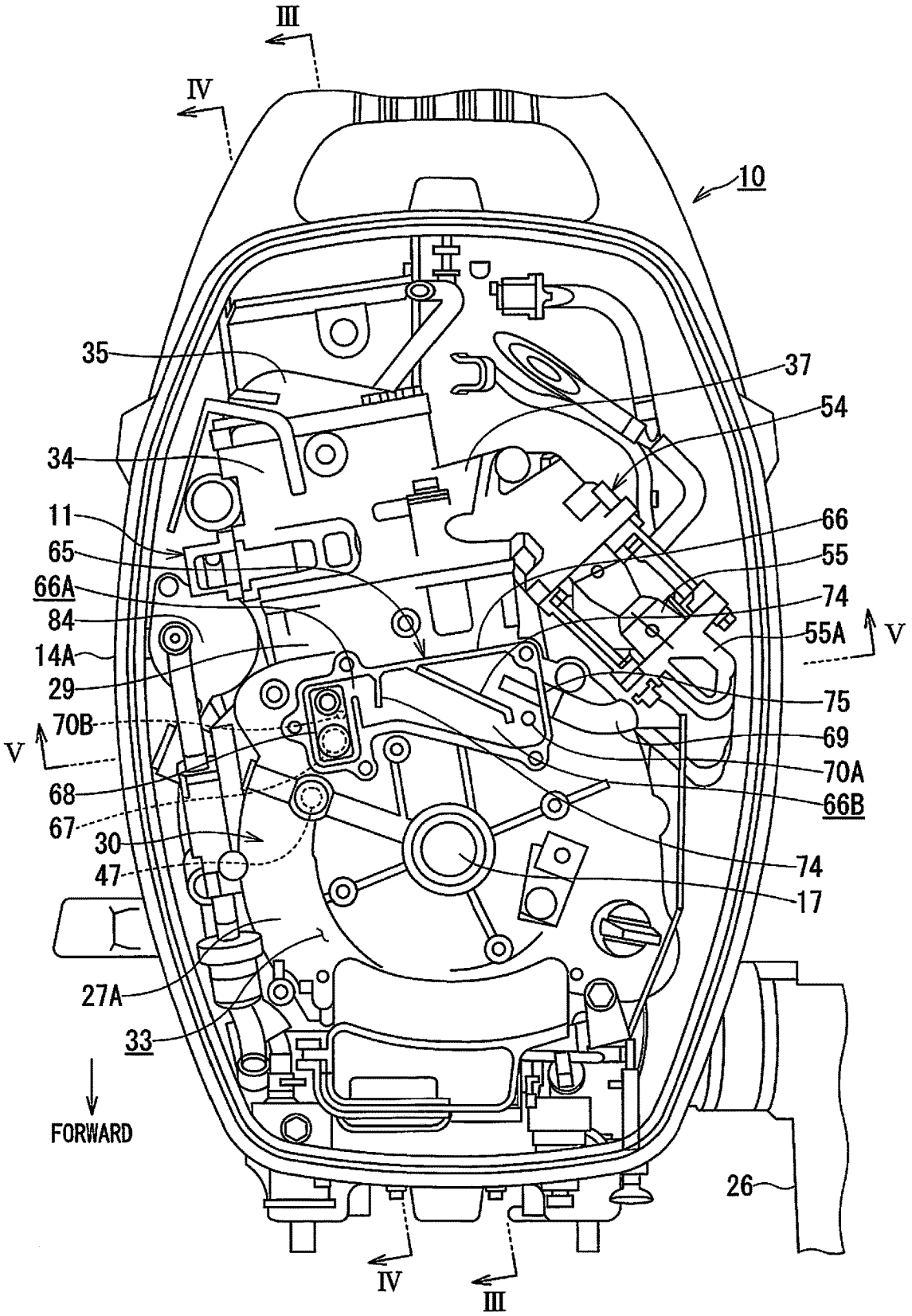
FIG. 2 is a plan view showing an engine and its surroundings in the outboard motor of FIG. 1.
Figure 3:
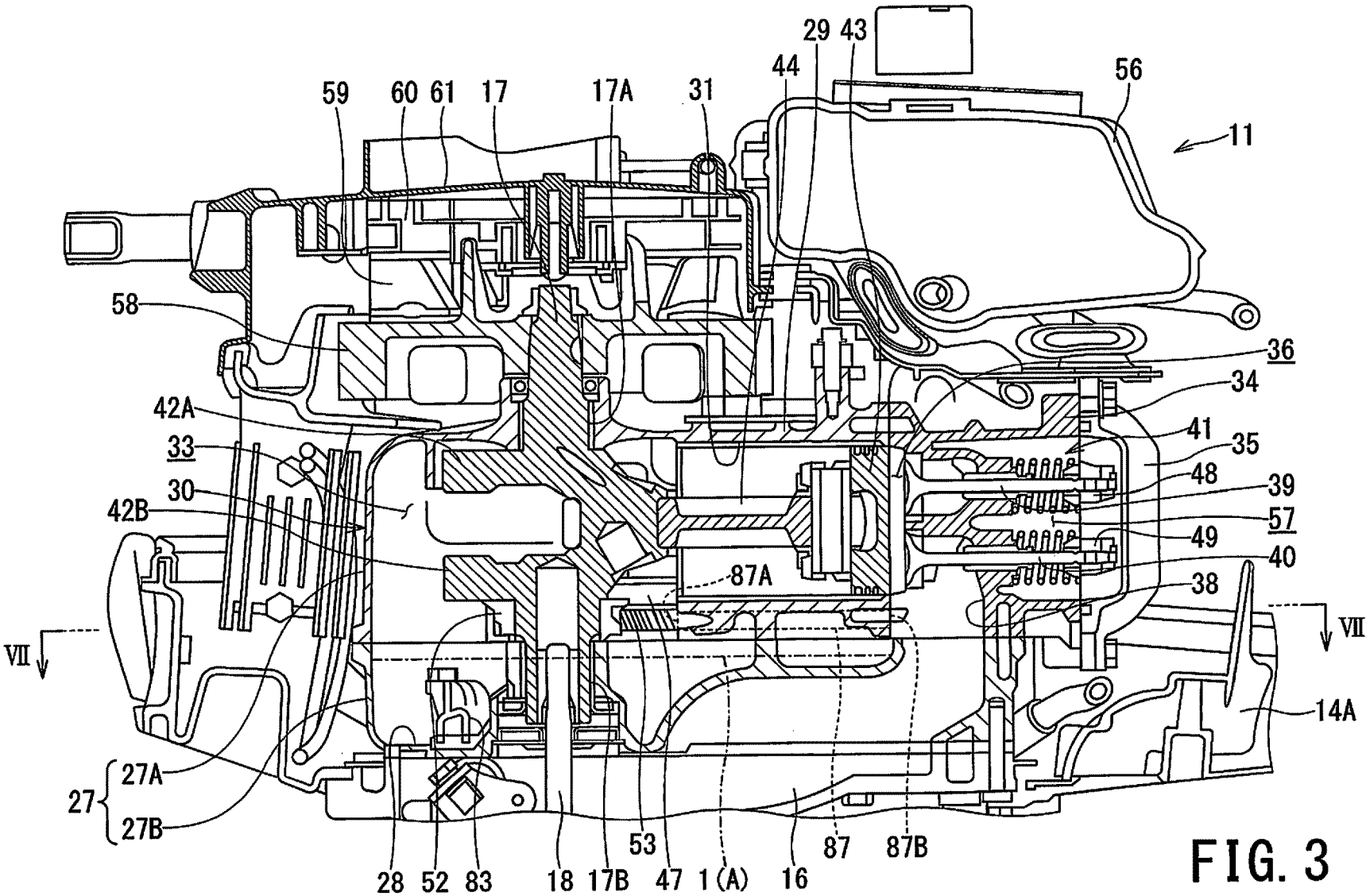
FIG. 3 is a sectional view taken along line III-III in FIG. 2.

FIG. 1 is a right side view showing an outboard motor equipped with an engine resulting from application of a lubricating structure for a four-stroke engine according to an embodiment of the present invention. The outboard motor 10 shown in FIGS. 1 to 3 is equipped with an engine holder 16, on which a vertical engine 11 is mounted. A drive shaft housing 12 is mounted integrally on the engine holder 16, extending downward and a gear case 13 is installed in a lower end portion of the drive shaft housing 12. The engine 11 and engine holder 16 are placed in an engine room 15 formed by being covered with an engine cover 14. The engine cover 14 includes a lower cover 14A attached to the engine holder 16 and an upper cover 14B detachably attached to the lower cover 14A.

The engine 11 is a vertical type in which a crankshaft 17 is mounted in a vertical direction. A drive shaft 18 coupled to the crankshaft 17 extends in the vertical direction in the drive shaft housing 12. The drive shaft 18 is connected to a propeller shaft 19 disposed horizontally in the gear case 13, via a shift mechanism 20, and a propeller 21 is mounted integrally rotatably on a rear end portion of the propeller shaft 19. A driving force of the engine 11 is transmitted from the crankshaft 17 to the propeller shaft 19 via the drive shaft 18 and the shift mechanism 20, turning the propeller 21 in a forward or reverse direction by the action of the shift mechanism 20 and thereby causing a hull 25 (described later) to move forward or backward.

An upper half of the drive shaft housing 12 is supported pivotally in a horizontal direction by a swivel bracket 22 provided around the drive shaft housing 12. The swivel bracket 22 is supported on a swivel shaft 23 pivotally in a vertical direction with respect to a clamp bracket 24, which grips a transom 25A of the hull 25. Since the swivel bracket 22 is installed pivotally in the vertical direction with respect to the clamp bracket 24, the outboard motor 10 is mounted on the hull 25 trimmably and tiltably in the vertical direction. Also, as the drive shaft housing 12 is installed pivotally in the horizontal direction with respect to the swivel bracket 22, the outboard motor 10 is installed steerably in the horizontal direction.

Note that in steering the outboard motor 10, a steering handle 26 is used. The steering handle 26 is pivotably supported by the engine holder 16 in the vertical direction and a throttle grip 26A for use to adjust output of the engine 11 is provided at a tip of the steering handle 26.

The engine 11 is, for example, a four-stroke single-cylinder engine of an OHV (Over Head Valve) type and includes a crankcase 27 made up of an upper crankcase half 27A and lower crankcase half 27B joined together splitably in an up-and-down direction. The lower crankcase half 27B of the crankcase 27 is fixedly supported by the engine holder 16. Also, as shown in FIGS. 3 and 4, an oil pan 28 configured to accumulate lubricating oil 1 is provided on a bottom of the lower crankcase half 27B.

Figure 4:
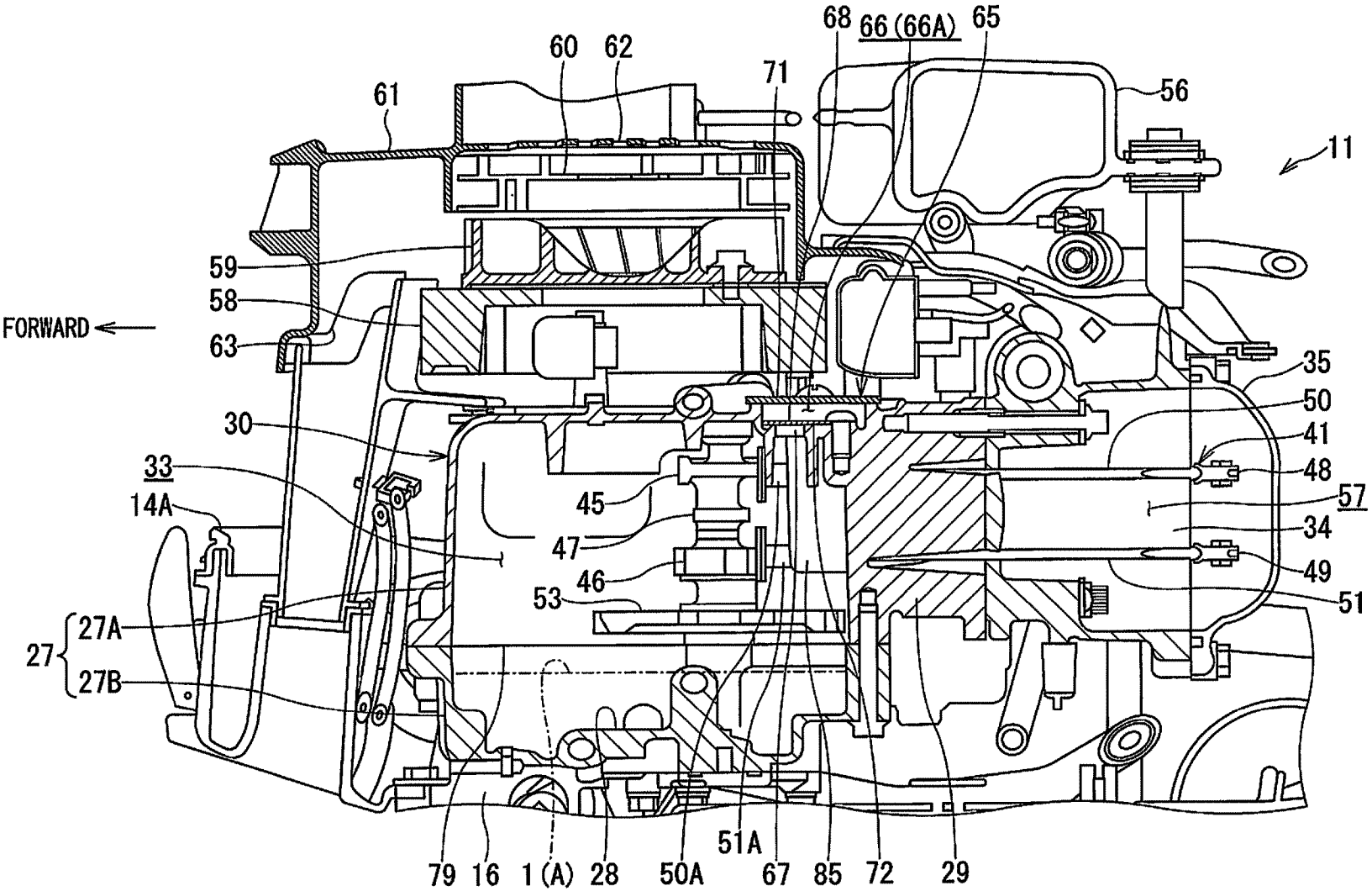
FIG. 4 is a sectional view taken along line IV-IV in FIG. 2.
Figure 5:
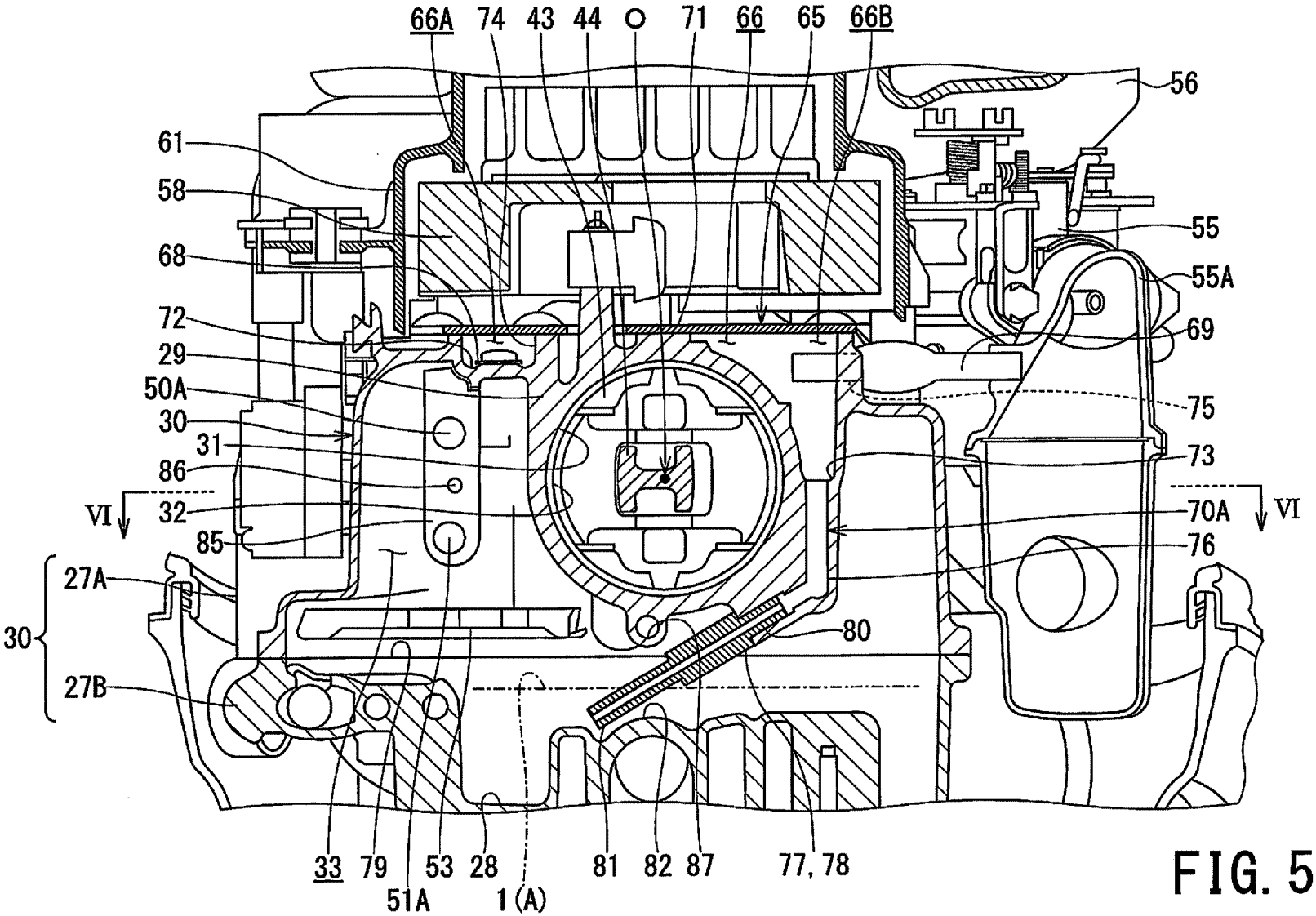
FIG. 5 is a sectional view taken along line V-V in FIG. 2.
Figure 6:
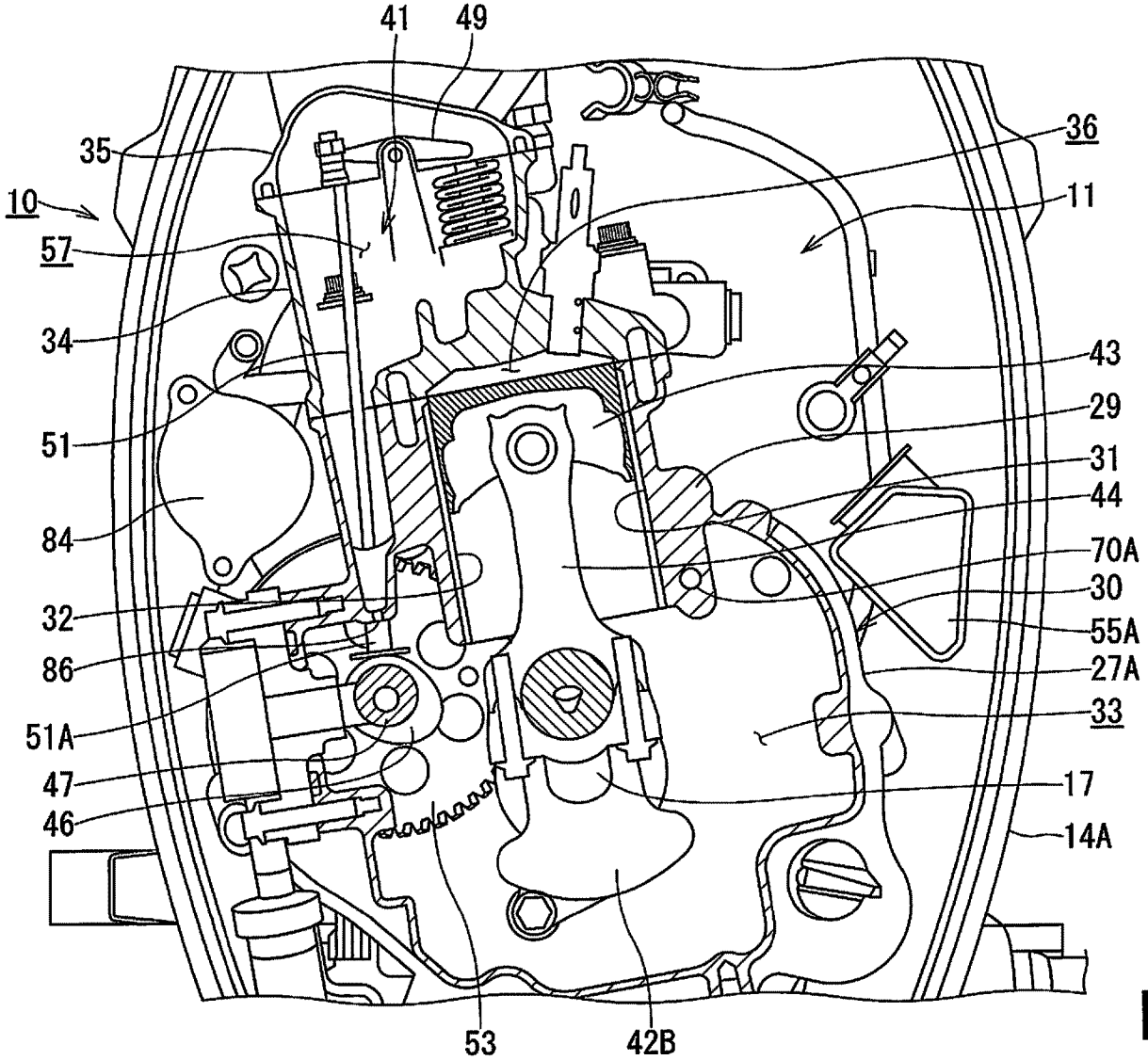
FIG. 6 is a sectional view taken along line VI-VI in FIG. 5.
Figure 8:
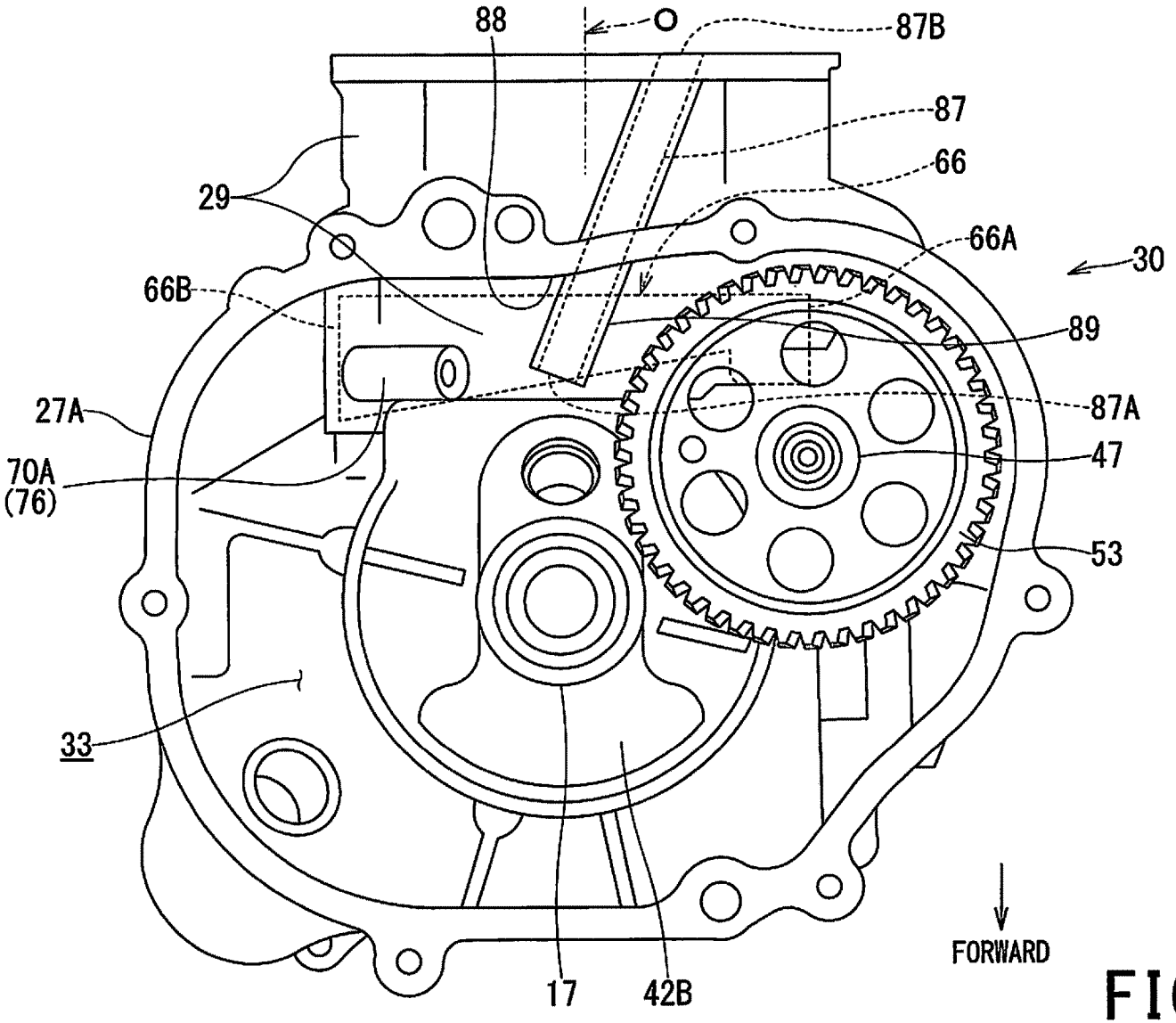
FIG. 8 is a bottom view of a cylinder block shown in FIG. 2.

As shown in FIGS. 2 to 4, the upper crankcase half 27A makes up the cylinder block 30 by being formed integrally with the cylinder 29. The cylinder 29 is installed in the upper crankcase half 27A, extending rearward in the horizontal direction. Also, as shown in FIGS. 5, 6, and 8, a cylinder bore 31 whose central axis O extends in the horizontal direction is formed in the cylinder 29, and a cylinder sleeve 32 is firmly fixed to an inner circumferential surface of the cylinder bore 31. Also, as shown in FIGS. 3 and 4, a crank chamber 33 configured to house the crankshaft 17 in the vertical direction is formed by the upper crankcase half 27A and lower crankcase half 27B, and the crankshaft 17 is rotatably supported by a bearing portion 17A of the upper crankcase half 27A and a bearing portion 17B of the lower crankcase half 27B. Also, the crank chamber 33 is located in forward part of the engine 11 while the cylinder 29 is located in rearward part of the engine 11.

With this engine 11, a cylinder head 34 and a head cover 35 are installed consecutively in sequence at a rear end of the cylinder 29 and at a rear end of the cylinder head 34, respectively. A non-illustrated combustion chamber 36 which conforms to the cylinder bore 31 of the cylinder 29 is formed in the cylinder head 34. Furthermore, an intake port 37 (FIG. 2) and an exhaust port 38 communicated with the combustion chamber 36 are formed in the cylinder head 34 and an intake valve 39 and exhaust valve 40 configured to open and close the intake port 37 and exhaust port 38, respectively, are disposed in the cylinder head 34. The intake valve 39 and exhaust valve 40 open and close by being driven by a valve driving mechanism 41 (described later).

On the crankshaft 17 housed in the crank chamber 33, a pair of crank webs 42A and 42B are formed at an approximate center position in an axial direction by being spaced away from each other in the axial direction. Also, in the cylinder bore 31 of the cylinder 29, a piston 43 is slidably disposed via the cylinder sleeve 32. The piston 43 is coupled with the crank webs 42A and 42B of the crankshaft 17 via a connecting rod 44, and consequently reciprocating motion of the piston 43 in the cylinder bore 31 is converted into rotary motion of the crankshaft 17.

As shown in FIG. 4, the OHV valve driving mechanism 41 configured to drive the intake valve 39 and exhaust valve 40 has a cam shaft 47 in the crank chamber 33, where the cam shaft 47 is equipped with an intake cam 45 and exhaust cam 46. The cam shaft 47 is placed in parallel to the crankshaft 17 (i.e., in the vertical direction) and rotatably supported on the upper crankcase half 27A and lower crankcase half 27B by a non-illustrated bearing portion. Also, an intake-side locker arm 48 and exhaust-side locker arm 49 are swingably supported in the cylinder head 34, and one end of the intake-side locker arm 48 abuts a valve stem of the intake valve 39 while one end of the exhaust-side locker arm 49 abuts a valve stem of the exhaust valve 40. Another end of the intake-side locker arm 48 is operatively coupled to the intake cam 45 via an intake-side push rod 50 and intake-side tappet 50A while another end of the exhaust-side locker arm 49 is operatively coupled to the exhaust cam 46 via an exhaust-side push rod 51 and exhaust-side tappet 51A.

As shown in FIGS. 3 and 4, a drive gear 52 is installed on the crankshaft 17 and a cam driven gear 53 is installed on the cam shaft 47. As the drive gear 52 and cam driven gear 53 mesh with each other, the cam shaft 47 rotates at a predetermined reduction ratio (e.g., ½) by a driving force of the crankshaft 17. As the cam shaft 47 rotates, the intake valve 39 opens and closes via the intake cam 45, intake-side push rod 50, intake-side tappet 50A and intake-side locker arm 48 while the exhaust valve 40 opens and closes via the exhaust cam 46, exhaust-side tappet 51A, exhaust-side push rod 51, and exhaust-side locker arm 49, with predetermined timings in synchronization with the crankshaft 17.

Here, as shown in FIGS. 3, 4, and 6, the intake valve 39, intake-side locker arm 48, intake-side push rod 50, exhaust valve 40, exhaust-side locker arm 49, and exhaust-side push rod 51 in the valve driving mechanism 41 described above are housed in a valve chamber 57 formed by being surrounded by the cylinder head 34 and head cover 35.

The intake port 37 shown in FIGS. 2 and 3 is communicated with a carburetor 55 which makes up an intake system 54 of the engine 11. The carburetor 55 includes a suction port 55A, produces fuel-air mixture from air (intake air) taken into the engine room 15 through the suction port 55A and fuel led from a fuel tank 56 and supplies the air-fuel mixture to the combustion chamber 36 of the engine 11. As the fuel-air mixture burns in the combustion chamber 36, the piston 43 reciprocates in the cylinder bore 31 of the cylinder 29. A carburetor 55 is placed together with the suction port 55A in one side portion in a width direction of the engine 11, e.g., in a left side portion, in the engine room 15. Also, as shown in FIGS. 3 and 4, the fuel tank 56 is installed above the cylinder 29 and cylinder head 34 of the cylinder block 30.

A flywheel magnet 58 of a power generator is mounted integrally rotatably on an upper end of the crankshaft 17 in upper part of the engine 11 and a ventilation fan 59 is firmly fixed to upper part of the flywheel magnet 58. A recoil starter pulley 60, which is an engine starter, is installed above the ventilation fan 59 integrally rotatably with the crankshaft 17. The flywheel magnet 58, ventilation fan 59, and recoil starter pulley 60 are covered with a fan cover 61. An airflow inlet 62 is formed in an upper surface of the fan cover 61 and an airflow outlet 63 is formed in lower front part of the fan cover 61.

As shown in FIGS. 2, 5, 6, and 9, gas under pressure generated in the combustion chamber 36 flows as blow-by gas into the crank chamber 33 through a clearance between the piston 43 and cylinder bore 31 (cylinder sleeve 32). Pressure of the blow-by gas in the crank chamber 33 constantly changes along with movement of the piston 43. Thus, the blow-by gas is led to the breather apparatus 65 in such a way that the pressure of the blow-by gas will not disturb movement of the piston 43. The breather apparatus 65 includes a breather chamber 66, a blow-by gas introduction hole 67, a one-way valve 68, a breather pipe 69, a first breather oil return passage 70A, and a second breather oil return passage 70B.

The breather chamber 66 is formed right under the flywheel magnet 58 in upper part of the cylinder block 30 in which the cylinder 29 and upper crankcase half 27A are constructed integrally. An upper opening of the breather chamber 66 is closed by a lid member 71. The breather chamber 66 is formed along substantially half a circumference of the cylinder bore 31 by straddling top part of the cylinder bore 31 of the cylinder 29 in a circumferential direction from one side to the other side. Consequently, the breather chamber 66 is constructed with one side portion 66A and a other side portion 66B in the circumferential direction of the cylinder bore 31 being communicated with each other.

The one side portion 66A of the breather chamber 66 is positioned on the side on which the cam shaft 47 of the valve driving mechanism 41 is installed. A bottom face 72 (FIGS. 4 and 5) of the one side portion 66A of the breather chamber 66 is installed at a level higher than the intake cam 45 and exhaust cam 46 of the cam shaft 47 (especially than the intake cam 45 located above the exhaust cam 46). This prevents splashes of lubricating oil produced by rotation of the cam shaft 47 from flying from the intake cam 45 and exhaust cam 46 (especially from the intake cam 45) and attaching to the bottom face 72 of the one side portion 66A of the breather chamber 66.

A bottom face 73 (FIG. 5) of the other side portion 66B of the breather chamber 66 is installed by projecting into the crank chamber 33 to a level lower than a bottom face 72 of the one side portion 66A and contributes to increasing volume of the breather chamber 66. Furthermore, a buffer wall 74 is formed in the breather chamber 66 in order for the blow-by gas flowing through the breather chamber 66 to collide with. As the blow-by gas collides with the buffer wall 74, oil in the blow-by gas is separated.

As shown in FIGS. 2, 4, 5, and 9, being formed at an end of the one side portion 66A of the breather chamber 66, the blow-by gas introduction hole 67 communicates the crank chamber 33 and breather chamber 66 with each other and leads the blow-by gas in the crank chamber 33 to the breather chamber 66. Also, being installed at an end of the one side portion 66A of the breather chamber 66, the one-way valve 68 opens and closes the blow-by gas introduction hole 67 along with pulsating pressure in the crank chamber 33. That is, the one-way valve 68 is designed to open the blow-by gas introduction hole 67 during pressurization of the crank chamber 33 and close the blow-by gas introduction hole 67 during depressurization of the crank chamber 33. Furthermore, the second breather oil return passage 70B is formed in the one side portion 66A of the breather chamber 66 by communicating the breather chamber 66 and crank chamber 33 with each other and used to return the oil separated in the breather chamber 66 to the crank chamber 33 when the one-way valve 68 is opened.

Figure 9:
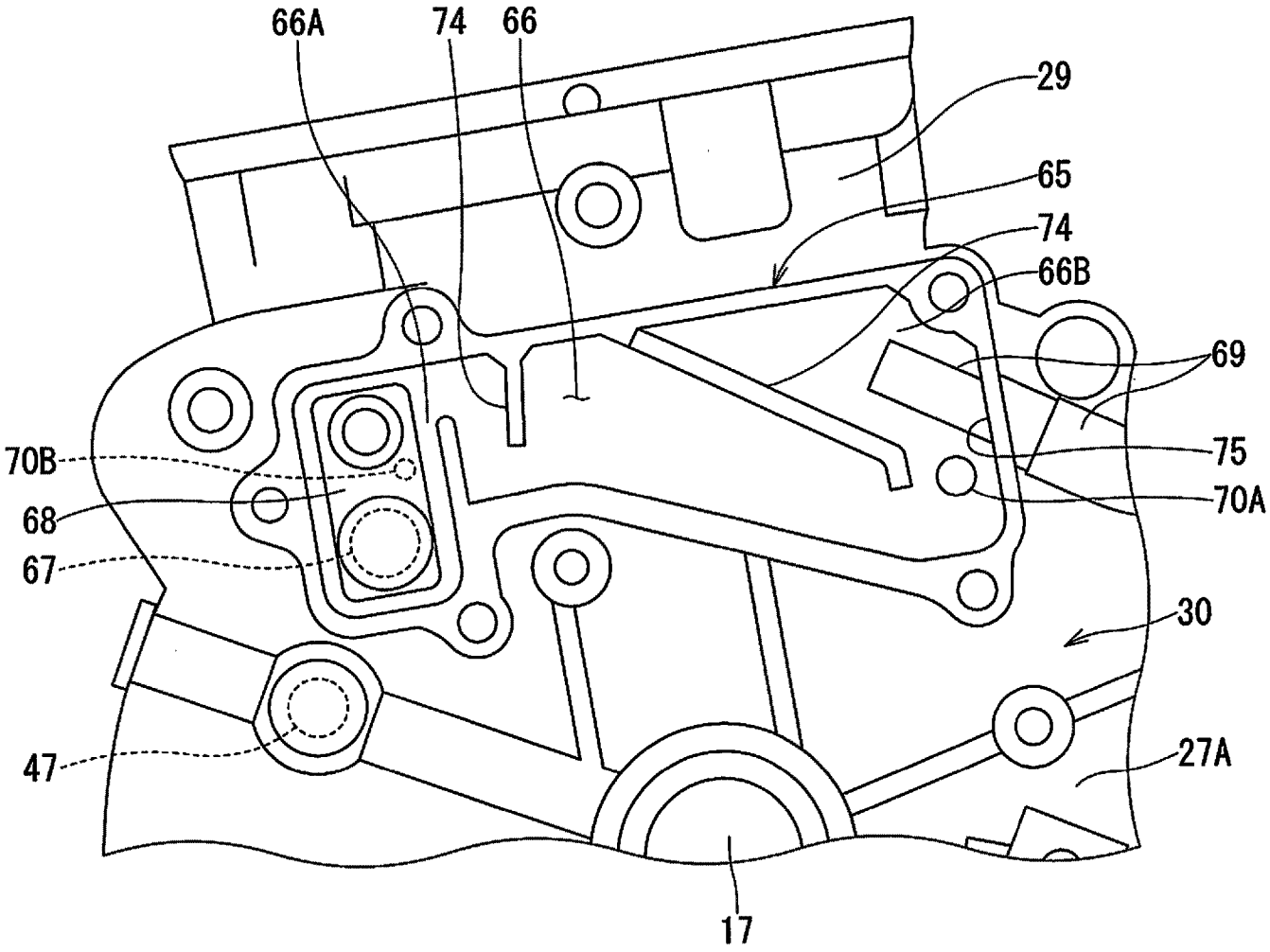
FIG. 9 is a partial plan view showing a breather apparatus of FIG. 2 and its surroundings in enlargement.

As shown in FIGS. 2, 5, and 9, the breather pipe 69 is communicated with the suction port 55A of the carburetor 55 and press-fitted in a pipe connection hole 75 formed in an end of the other side portion 66B of the breather chamber 66. By being press-fitted in the pipe connection hole 75, the breather pipe 69 is connected to the breather chamber 66 and thereby connected to the carburetor 55 of the intake system 54 of the engine 11 through the breather pipe 69. The blow-by gas from which oil has been separated in the breather chamber 66 is led to the carburetor 55 through the breather pipe 69.

As shown in FIGS. 2, 5, and 9, the first breather oil return passage 70A is formed in an end of the other side portion 66B of the breather chamber 66 and returns the oil separated in the breather chamber 66 to the crank chamber 33 by communicating the breather chamber 66 and crank chamber 33 with each other. The first breather oil return passage 70A includes a cylinder-side portion 76 formed along the cylinder bore 31 integrally with an outer circumference of the cylinder 29 and an extending portion 77 extending out of the cylinder-side portion 76.

The extending portion 77 reaches a lower part of the crank chamber 33 below oil level A of the lubricating oil 1 accumulated in the oil pan 28 in the lower crankcase half 27B and extends to under the cylinder bore 31 and to the side of the one side portion 66A on an opposite side over a central axis O of the cylinder bore 31. Specifically, the extending portion 77 is a tubular member 78 separate from the cylinder 29 and detachable from the cylinder-side portion 76. The tubular member 78 extends to below the cylinder 29 and an approximate lower half of the tubular member 78 is located below a dividing plane 79 between the upper crankcase half 27A and lower crankcase half 27B. That is, a base end 80 of the tubular member 78 on an upper side is joined to the cylinder-side portion 76 of the upper crankcase half 27A by being inserted thereinto while a tip 81 on a lower side is positioned close to a bottom face 82 of the lower crankcase half 27B by being opposed thereto.

Next, operation of the breather apparatus 65 will be described mainly with reference to FIGS. 2, 4, 5, and 9.

During operation of the engine 11, the one-way valve 68 opens and closes the blow-by gas introduction hole 67 along with the pulsating pressure in the crank chamber 33 resulting from reciprocation of the piston 43, and consequently the blow-by gas from the crank chamber 33 flows into the one side portion 66A of the breather chamber 66 through the blow-by gas introduction hole 67. When the blow-by gas flowing into the one side portion 66A flows toward the other side portion 66B, the flow path cross-sectional area decreases at a position directly above the central axis O of the cylinder bore 31, increasing flow velocity. When the blow-by gas reaches the other side portion 66B, the flow velocity decreases slowly as the flow path cross-sectional area increases gradually. Furthermore, while flowing from the one side portion 66A of the breather chamber 66 to the other side portion 66B, the blow-by gas collides with the buffer wall 74.

Oil is separated from the blow-by gas due to the above-described changes in the flow velocity and collision with the buffer wall 74, and the blow-by gas from which oil has been separated is supplied to the suction port 55A of the carburetor 55 through the breather pipe 69. Also, the oil separated from the blow-by gas is returned to the oil pan 28 in the crank chamber 33 through the first breather oil return passage 70A and second breather oil return passage 70B.

Figure 7:
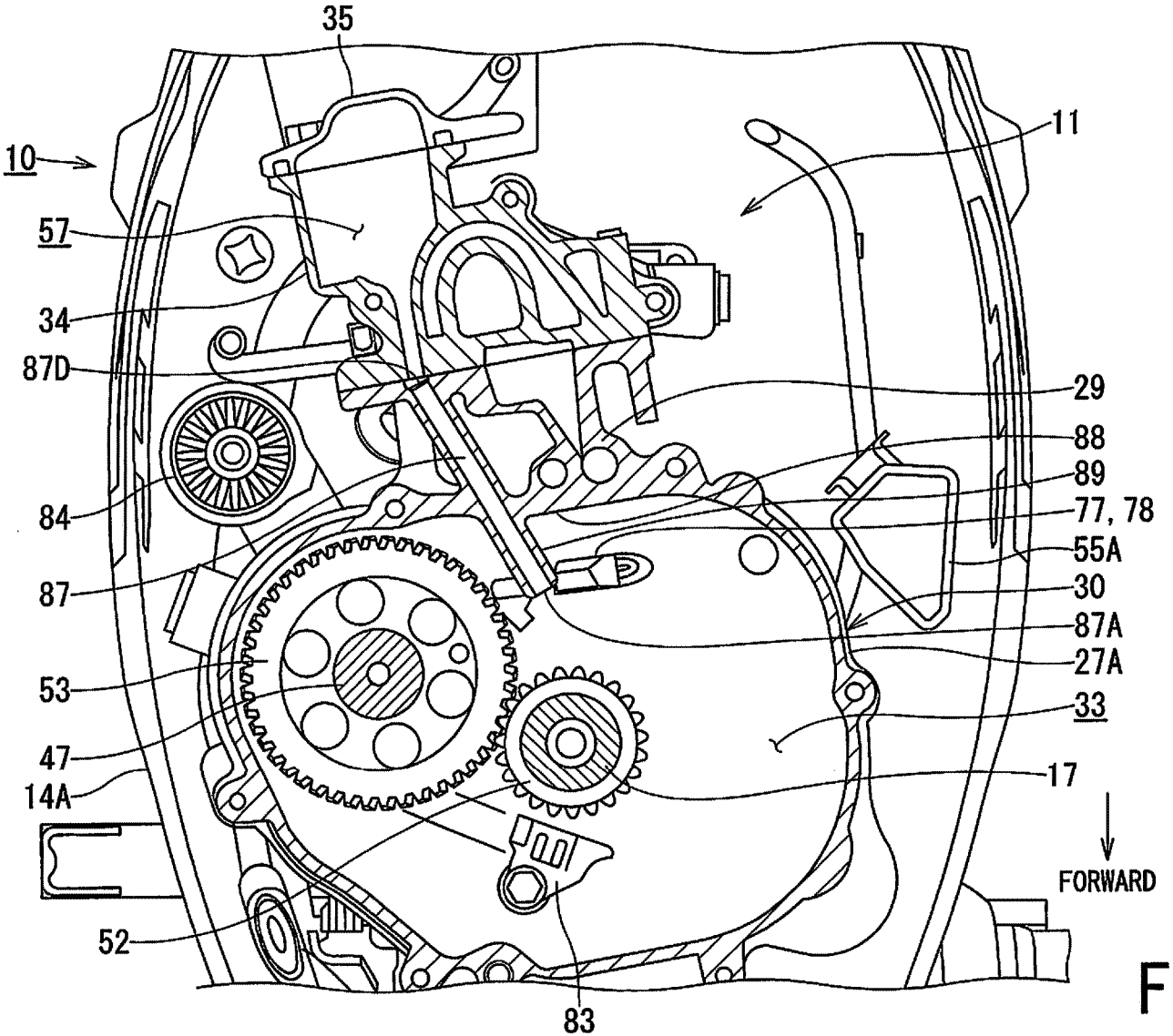
FIG. 7 is a sectional view taken along line VII-VII in FIG. 3.

As shown in FIGS. 3, 4 and 7, the lubricating oil 1 accumulated in the oil pan 28 in the lower crankcase half 27B of the crank chamber 33 passes through an oil strainer 83 installed in the lower crankcase half 27B and is drawn in by a non-illustrated oil pump driven by the cam shaft 47. The lubricating oil 1 discharged from the oil pump is supplied to the bearing portions 17A and 17B of the crankshaft 17 and a bearing portion (not illustrated) of the cam shaft 47 through the oil filter 84 and lubricates these components.

The lubricating oil 1 supplied to the bearing portions 17A and 17B of the crankshaft 17 and the like is turned into a mist (spray) by the rotation of the crankshaft 17 to lubricate the connecting rod 44, piston 43, intake cam 45, exhaust cam 46, and the like and is further introduced into the valve chamber 57 to lubricate the valve driving mechanism 41, including the intake-side locker arm 48 and exhaust-side locker arm 49. A lubricating structure of the valve driving mechanism 41 will be described below.

As shown in FIGS. 5 and 6, in the upper crankcase half 27A of the cylinder block 30, a first oil groove 86 capable of introducing the mist of the lubricating oil 1 into the valve chamber 57 from the crank chamber 33 by communicating the crank chamber 33 and valve chamber 57 with each other is formed in a tappet guide 85 configured to guide the intake-side tappet 50A and exhaust-side tappet 51A of the valve driving mechanism 41. The first oil groove 86 is provided between the intake-side tappet 50A and exhaust-side tappet 51A of the tappet guide 85. An opening in the first oil groove 86 on the side of the crank chamber 33 is set above the oil level A of the lubricating oil 1 accumulated in the oil pan 28 in the crank chamber 33, regardless of whether during normal operation of the outboard motor 10 in which the hull 25 remains horizontal, or during acceleration operation in which the hull 25 rises on the bow side.

Also, as shown in FIGS. 3, 5, 7, and 8, a second oil groove 87 is formed in a lower part of the outer circumference of the cylinder 29 in the cylinder block 30, extending diagonally with respect to the central axis O of the cylinder bore 31. The second oil groove 87 communicates a lower part of the valve chamber 57 with a neighborhood of the oil pan 28 in the crank chamber 33, making it possible to introduce surplus lubricating oil 1 in the valve chamber 57 into the oil pan 28 in the crank chamber 33. As shown especially in FIGS. 7 and 8, the second oil groove 87 is formed in a protruding portion 89 along a protruding direction of the protruding portion 89, which protrudes forward of the outboard motor 10 on a center side of the crank chamber 33 from an inner rear part 88 of the upper crankcase half 27A facing the crank chamber 33. Also, during normal operation of the outboard motor 10 in which the hull 25 remains horizontal, an opening 87A in the second oil groove 87 on the side of the crank chamber 33 is set above the oil level A of the lubricating oil 1 accumulated in the oil pan 28 in the crank chamber 33.

Figure 10A:
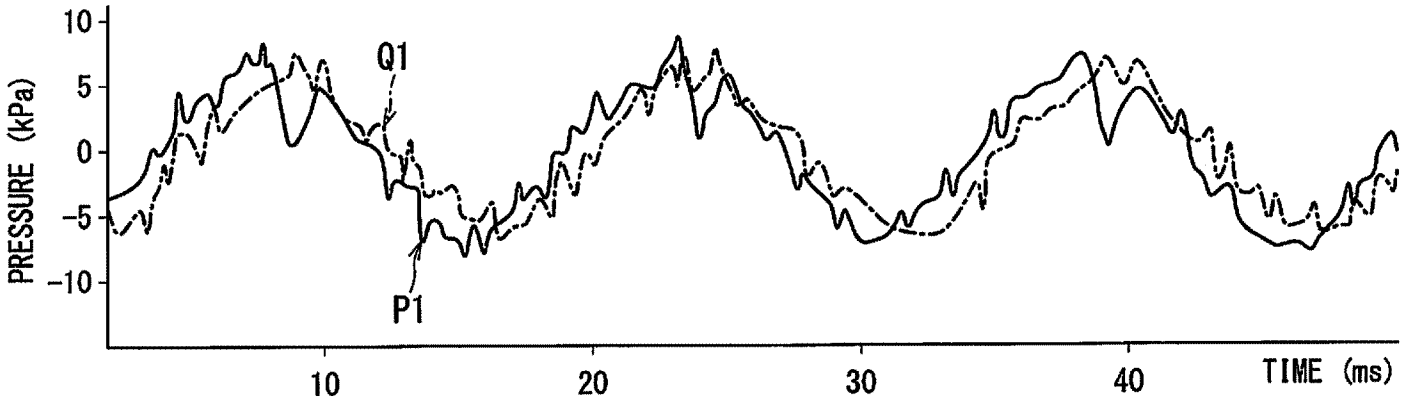
FIGS. 10A and 10B are graphs showing pressure changes in the crank chamber and a valve chamber of FIG. 3.

Regarding the first oil groove 86 and second oil groove 87 described above, the first oil groove 86 is set smaller in flow path cross-sectional area than the second oil groove 87. With the four-stroke single-cylinder engine 11 according to the present embodiment, reciprocating motion of the piston 43 causes pressure in the crank chamber 33 to pulsate by alternating positive pressure and negative pressure, and pressure in the valve chamber 57 communicated with the crank chamber 33 through the first oil groove 86 and second oil groove 87 also pulsates by alternating positive pressure and negative according to the pressure in the crank chamber 33. If the first oil groove 86 is equal to or larger in diameter than the second oil groove 87, pressure P1 in the valve chamber 57 alternates positive pressure and negative pressure substantially in synchronization with pressure Q1 in the crank chamber 33 as shown in FIG. 10A.

Figure 10B:
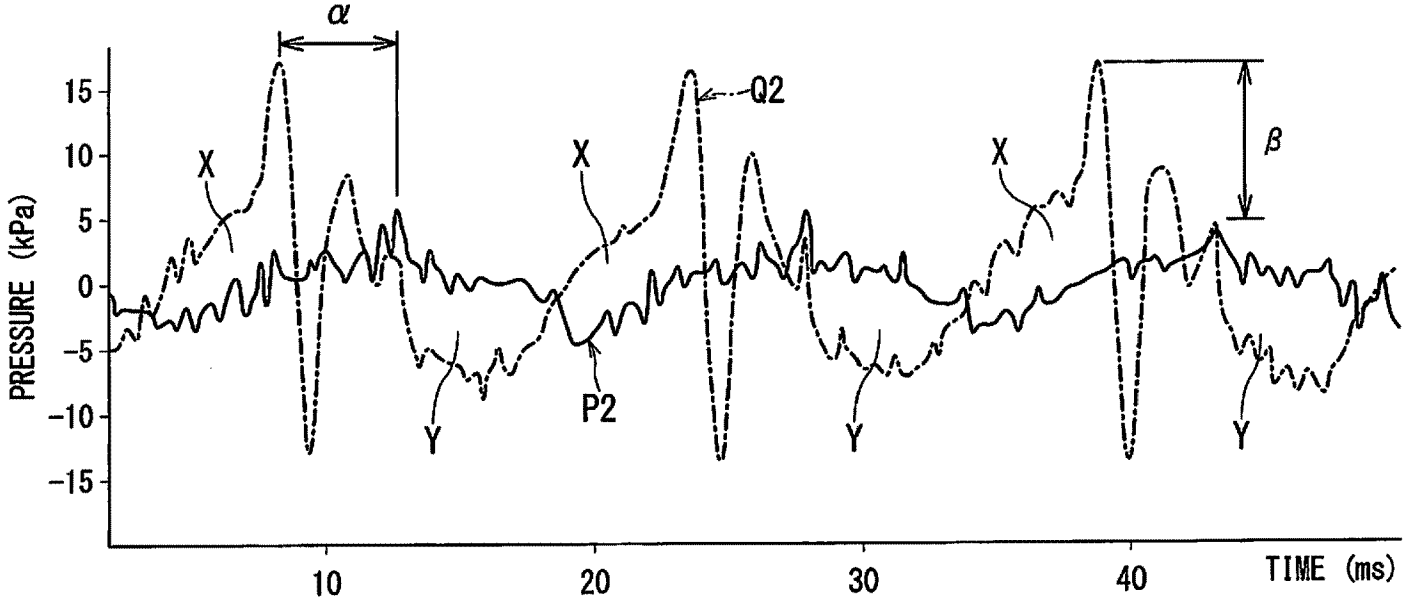

In contrast, when the first oil groove 86 is set smaller in flow path cross-sectional area than the second oil groove 87 as with the present embodiment, pressure P2 in the valve chamber 57 causes a pulsation difference such as a pulsation delay (phase difference $\alpha$) or amplitude reduction (amplitude difference $\beta$) with respect to pressure Q2 in the crank chamber 33 as shown in FIG. 10B. This produces a state X in which the pressure P2 in the valve chamber 57 is lower than the pressure Q2 in the crank chamber 33 and a state Y in which the pressure P2 is higher than the pressure Q2. Upon entry into the state X in which the pressure P2 in the valve chamber 57 is lower than the pressure Q2 in the crank chamber 33, the mist of the lubricating oil 1 in the crank chamber 33 is introduced into the valve chamber 57 through the first oil groove 86 of a small diameter to lubricate the valve driving mechanism 41. Upon entry into the state Y in which the pressure P2 in the valve chamber 57 is higher than the pressure Q2 in the crank chamber 33, the surplus lubricating oil 1 accumulated in the lower part of the valve chamber 57 is returned into the crank chamber 33 through the second oil groove 87 of a large diameter.

Furthermore, as shown in FIGS. 5, 6, 7, and 9, the following relational expression holds among respective flow path cross-sectional areas of the first oil groove 86, second oil groove 87, and blow-by gas introduction hole 67, and a total flow path cross-sectional area of the first breather oil return passage 70A and second breather oil return passage 70B.

First and second breather oil return passages≤first oil groove<second oil groove<blow-by gas introduction hole For example, the total flow path cross-sectional area of the first breather oil return passage 70A and second breather oil return passage 70B is set to 6.3 $mm^2$, the flow path cross-sectional area of the first oil groove 86 is set to 7.0 $mm^2$, the flow path cross-sectional area of the second oil groove 87 is set to 28.0 $mm^2$, and the flow path cross-sectional area of the blow-by gas introduction hole 67 is set to 78.5 $mm^2$.

The first and second breather oil return passages 70A and 70B and the blow-by gas introduction hole 67 are passages configured to communicate the crank chamber 33 with the intake system 54 of the engine 11 via the breather chamber 66 and when sizes of the flow path cross-sectional areas of the passages, including the first breather oil return passage 70A, second breather oil return passage 70B, and blow-by gas introduction hole 67, used by the crank chamber 33 to communicate with other regions are prescribed as indicated by the above relational expression, the above-described inflow and outflow of the lubricating oil 1 occur effectively between the crank chamber 33 and valve chamber 57.

Being configured as described above, the present embodiment provides the following advantages (1) to (3).

(1) As shown in FIGS. 3, 6 and 7, as a result of the reciprocating motion of the piston 43, the pressure in the crank chamber 33 pulsates by alternating positive pressure and negative pressure, and accordingly, the pressure in the valve chamber 57 also pulsates by alternating positive pressure and negative pressure. In so doing, due to a difference in cross-sectional areas of the first oil groove 86 and second oil groove 87 which communicate the crank chamber 33 and valve chamber 57 with each other, the pressure in the valve chamber 57 causes a pulsation difference such as a pulsation delay (phase difference $\alpha$ in FIG. 10B) or amplitude reduction (amplitude difference $\beta$ in FIG. 10B) with respect to the pressure in the crank chamber 33 and results in a state of being higher than the pressure in the crank chamber 33 (Y in FIG. 10B).

Now, when the first oil groove 86 is set smaller in flow path cross-sectional area than the second oil groove 87, it becomes easy for a fluid to flow through the second oil groove 87 and thus surplus lubricating oil 1 accumulated in the lower part of the valve chamber 57 can be returned to the crank chamber 33 through the second oil groove 87 upon entry into the state Y in which the pressure in the valve chamber 57 becomes higher than the pressure in the crank chamber 33. Consequently, surplus lubricating oil 1 can properly be returned to the oil pan 28 in the crank chamber 33 from within the valve chamber 57 of the cylinder head 34 without using a dedicated part (e.g., a check valve such as described in Description of the Related Art).

This solves shortage of lubricating oil in the oil pan 28 and allows the bearing portions 17A and 17B of the crankshaft 17 to be lubricated reliably. Furthermore, a valve stem of the intake valve 39 can be prevented from being immersed in the lubricating oil 1 in the valve chamber 57, and thus intrusion of lubricating oil into the intake port 37 through the intake valve 39 can be avoided and combustion of the lubricating oil 1 in the combustion chamber 36 can be prevented.

(2) As shown in FIGS. 6, 7, and 9, the following relational expression holds among the respective flow path cross-sectional areas of the first oil groove 86, second oil groove 87, and blow-by gas introduction hole 67, and the total flow path cross-sectional area of the first breather oil return passage 70A and second breather oil return passage 70B.

First and second breather oil return passages≤first oil groove<second oil groove<blow-by gas introduction hole.

This makes it possible to reliably cause a pulsation difference between the pressure in the crank chamber 33 and pressure in the valve chamber 57. Furthermore, the openings in the first oil groove 86 and second oil groove 87 on the side of the crank chamber 33 are positioned above the lubricating oil 1 accumulated in the oil pan 28 of the crank chamber 33 during normal operation of the outboard motor 10. Therefore, misty lubricating oil 1 can be introduced more effectively into the valve chamber 57 from the crank chamber 33 through the first oil groove 86 and the surplus lubricating oil 1 can be discharged more effectively from the valve chamber 57 to the crank chamber 33 through the second oil groove 87.

Figure 11:
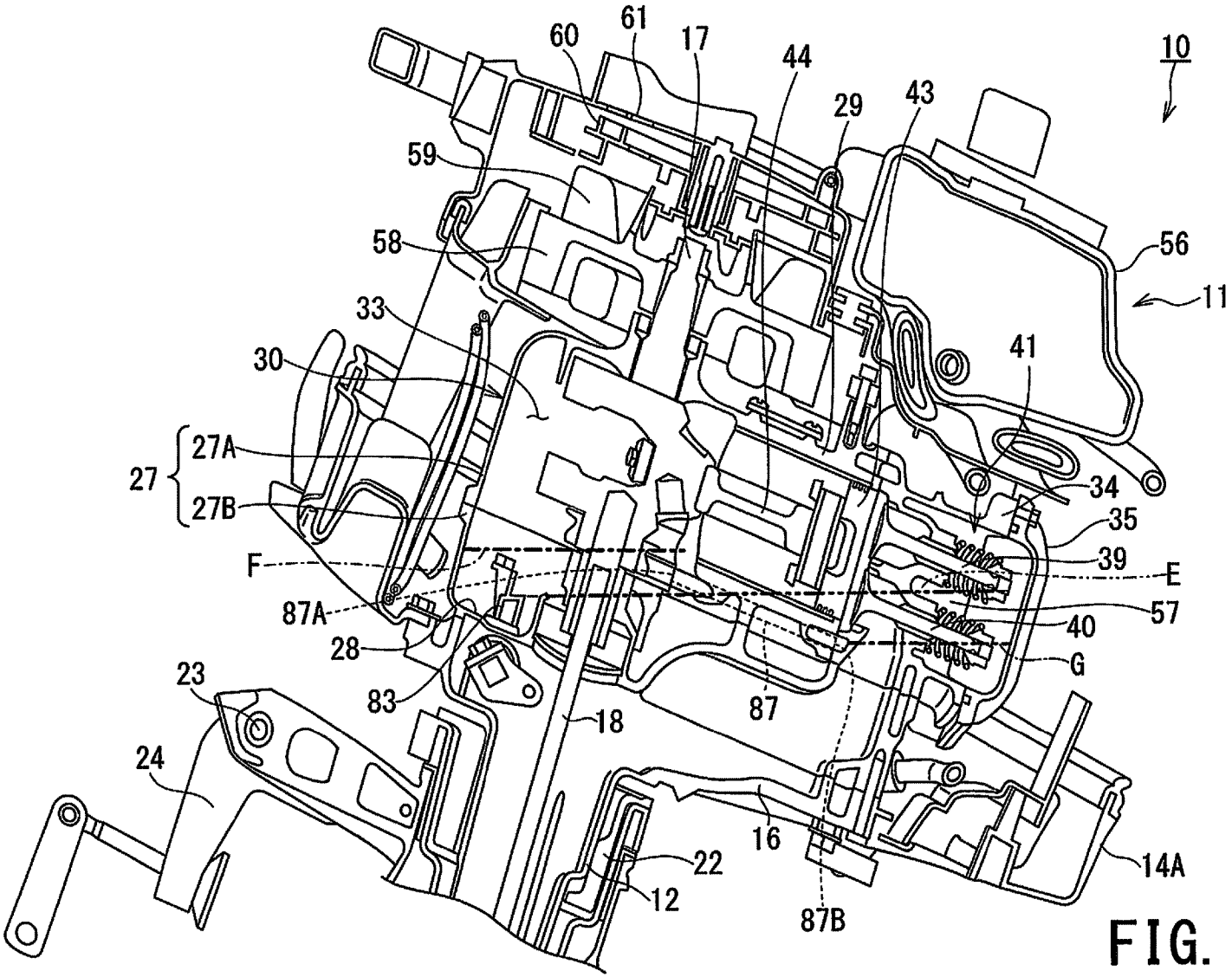
FIG. 11 is a left sectional view showing a tilted state of an outboard motor shown in FIG. 1 during acceleration of a hull equipped with the outboard motor.

(3) When the outboard motor 10 is tilted rearward during acceleration of the hull 25 shown in FIG. 11, if the lubricating oil 1 in the valve chamber 57 is not returned sufficiently to the crank chamber 33, the lubricating oil 1 in the valve chamber 57 and crank chamber 33 shifts rearward in the valve chamber 57 and crank chamber 33, with an oil level E thereof reaching a position indicated by a broken line in FIG. 11. Consequently, an amount of lubricating oil 1 absorbed by the oil strainer 83 in the crank chamber 33 might be insufficient.

In contrast, according to the present embodiment, as shown in FIGS. 3, 7, and 8, the second oil groove 87 is also formed in the protruding portion 89 along the protruding direction of the protruding portion 89, which protrudes to the center side of the crank chamber 33 from the inner rear part 88 of the upper crankcase half 27A facing the crank chamber 33. Therefore, as shown in FIG. 11, when the outboard motor 10 assumes a posture tilted rearward during acceleration of the hull 25, the opening 87A in the second oil groove 87 on the side of the crank chamber 33 is positioned above an opening 87B on the side of the valve chamber 57.

Consequently, in a tilted posture of the outboard motor 10, the opening 87A in the second oil groove 87 on the side of the crank chamber 33 is less apt to fall below an oil level F of the lubricating oil 1 in the oil pan 28 of the crank chamber 33. This makes it possible to properly continue a discharge action of returning (discharging) lubricating oil from the valve chamber 57 into the crank chamber 33 through the second oil groove 87 by using the pulsation difference in internal pressure between the crank chamber 33 and valve chamber 57. Furthermore, because the lubricating oil 1 from the oil pan 28 in the crank chamber 33 is less apt to flow back to the valve chamber 57 by passing through the second oil groove 87, an oil level G of the lubricating oil 1 in the valve chamber 57 can be kept low and the oil level F of the lubricating oil 1 in the oil pan 28 in the crank chamber 33 can be kept high. This ensures that a sufficient amount of lubricating oil 1 will be absorbed by the oil strainer 83.

Although an embodiment of the present invention has been described, the embodiment is presented only by way of example, and not intended to limit the scope of the invention. The embodiment can be implemented in various other forms, and various omissions, replacements, and changes can be made without departing from the spirit of the invention.

What is claimed is:

1. A lubricating structure for a four-stroke engine, the four-stroke engine including a crankcase, a cylinder, a cylinder head and an oil pan, the crankcase making up a crank chamber, the cylinder with a piston slidably disposed therein being installed extending horizontally in the crankcase, the cylinder head being installed consecutively with the cylinder and being equipped with a valve chamber configured to house valve driving mechanism, and the oil pan configured to accumulate lubricating oil being provided on a bottom of the crank chamber, the lubricating structure comprising:

a first oil groove configured to lead mist of the lubricating oil in the crank chamber to the valve chamber by communicating the crank chamber and the valve chamber with each other; and a second oil groove configured to lead surplus lubricating oil in the valve chamber to the oil pan in the crank chamber by communicating a lower part of the valve chamber with a neighborhood of the oil pan in the crank chamber, wherein the first oil groove is set smaller in flow path cross-sectional area than the second oil groove.

2. The lubricating structure for the four-stroke engine according to claim 1, wherein:

the four-stroke engine includes a breather apparatus configured to lead blow-by gas in the crank chamber to a breather chamber, separate oil from the blow-by gas, and then supply the blow-by gas to an intake system;

the breather chamber includes a blow-by gas introduction hole configured to lead the blow-by gas in the crank chamber to the breather chamber and configured to be opened and closed by a one-way valve, and a breather oil return passage configured to return the oil separated in the breather chamber to the crank chamber; and in terms of flow path cross-sectional area, the first oil groove, the second oil groove, the blow-by gas introduction hole, and the breather oil return passage are set to satisfy a relationship:

the breather oil return passage≤the first oil groove<the second oil groove<the blow-by gas introduction hole.

3. The lubricating structure for the four-stroke engine according to claim 1, wherein:

the four-stroke engine is an engine for an outboard motor, in which a crankshaft housed in the crank chamber is placed in a vertical direction and the cylinder is installed extending rearward in a horizontal direction from the crankcase; and openings in the first oil groove and the second oil groove on a side of the crank chamber are positioned above an oil level of the lubricating oil accumulated in the oil pan during normal operation of the outboard motor.

4. The lubricating structure for the four-stroke engine according to claim 2, wherein:

the four-stroke engine is an engine for an outboard motor, in which a crankshaft housed in the crank chamber is placed in a vertical direction and the cylinder is installed extending rearward in a horizontal direction from the crankcase; and openings in the first oil groove and the second oil groove on a side of the crank chamber are positioned above an oil level of the lubricating oil accumulated in the oil pan during normal operation of the outboard motor.

5. The lubricating structure for the four-stroke engine according to claim 1, wherein:

the four-stroke engine is an engine for an outboard motor, in which a crankshaft housed in the crank chamber is placed in a vertical direction and the cylinder is installed extending rearward in a horizontal direction from the crankcase; and the second oil groove is formed in a protruding portion along a protruding direction of the protruding portion which protrudes forward of the outboard motor from inner rear part of the crankcase, the inner rear part facing the crank chamber.

6. The lubricating structure for the four-stroke engine according to claim 2, wherein:

the four-stroke engine is an engine for an outboard motor, in which a crankshaft housed in the crank chamber is placed in a vertical direction and the cylinder is installed extending rearward in a horizontal direction from the crankcase; and the second oil groove is formed in a protruding portion along a protruding direction of the protruding portion which protrudes forward of the outboard motor from inner rear part of the crankcase, the inner rear part facing the crank chamber.

7. The lubricating structure for the four-stroke engine according to claim 3, wherein:

the four-stroke engine is an engine for an outboard motor, in which a crankshaft housed in the crank chamber is placed in a vertical direction and the cylinder is installed extending rearward in a horizontal direction from the crankcase; and the second oil groove is formed in a protruding portion along a protruding direction of the protruding portion which protrudes forward of the outboard motor from inner rear part of the crankcase, the inner rear part facing the crank chamber.

8. The lubricating structure for the four-stroke engine according to claim 4, wherein:

the four-stroke engine is an engine for an outboard motor, in which a crankshaft housed in the crank chamber is placed in a vertical direction and the cylinder is installed extending rearward in a horizontal direction from the crankcase; and the second oil groove is formed in a protruding portion along a protruding direction of the protruding portion which protrudes forward of the outboard motor from inner rear part of the crankcase, the inner rear part facing the crank chamber.

* * * * *